United States Patent [19]

Fujimura et al.

[11] 4,417,179

[45] Nov. 22, 1983

[54] LIGHT QUANTITY CONTROL DEVICE

[75] Inventors: Takashi Fujimura, Mobara; Kazuo Kato, Kitahassakumachi, both of Japan

[73] Assignee: Hitachi, Ltd., Tokyo, Japan

[21] Appl. No.: 376,030

[22] Filed: May 7, 1982

[30] Foreign Application Priority Data

May 8, 1981 [JP] Japan ..... 56-68302

[51] Int. Cl.[3] ..... H05B 37/02

[52] U.S. Cl. ..... 315/151; 250/205; 250/214 L; 315/156; 315/158; 315/199

[58] Field of Search ..... 315/151, 156, 158, 307, 315/194, 199; 250/205, 214 L; 355/69

[56] References Cited

U.S. PATENT DOCUMENTS

| | | | |
|---|---|---|---|
| 3,670,202 | 6/1972 | Paine et al. | 315/151 X |
| 4,190,795 | 2/1980 | Schultheis | 315/158 X |
| 4,203,032 | 5/1980 | Haunstetter et al. | 315/151 X |

*Primary Examiner*—Eugene R. La Roche

*Attorney, Agent, or Firm*—Antonelli, Terry & Wands

[57] ABSTRACT

A light quantity control device for controlling the quantity of light emitted from a light source supplied with a.c. power through a bidirectional switching element is disclosed which comprises an integrating circuit for integrating an electric signal corresponding to the quantity of emitted light to produce a light quantity signal varying in accordance with a change in quantity of emitted light and another integrating circuit for integrating the light quantity signal with a predetermined period to produce an exponentially rising signal for every predetermined period, and in which the output of the latter integrating circuit is compared with a reference value to obtain a control signal having a duration time corresponding to the results of comparison, and the switching element is controlled by the control signal to perform a phase control for the a.c. power.

4 Claims, 7 Drawing Figures

LIGHT QUANTITY CONTROL DEVICE

FIELD OF THE INVENTION

The present invention relates to a light quantity control device suitable for use in a light source apparatus for exposing a light sensitive material through a mask pattern.

DESCRIPTION OF THE PRIOR ART

When a light sensitive material is exposed to light through a mask pattern to obtain a fine pattern, especially, when a projection exposure is carried out, dimensions of the fine pattern obtained after processing (for example, development) vary with the quantity of light incident upon the light sensitive material. Accordingly, it is usually required to control the quantity of light incident upon the light sensitive material so as to be kept constant within ±1%.

In order to meet this requirement, a light source apparatus for exposing a light sensitive material is provided with a light quantity control device for maintaining constant the quantity of light emitted from a light source.

Figure 1:
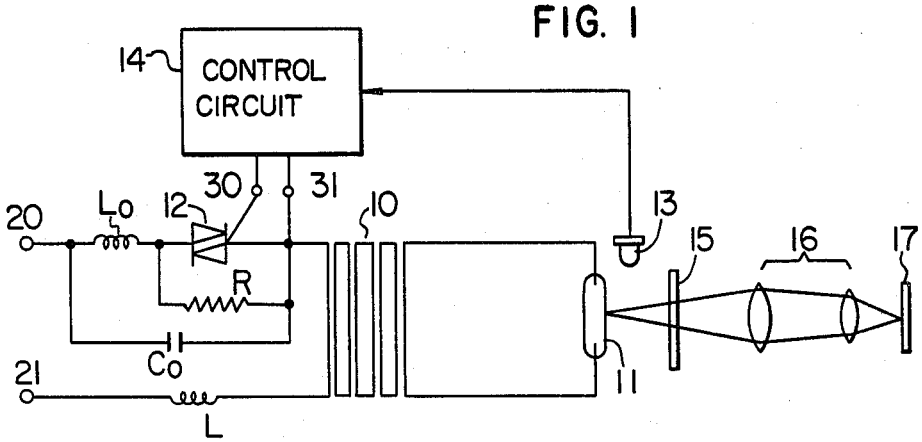
FIG. 1 is a view showing a light source apparatus provided with a light quantity control device for exposing a light sensitive material through a mask pattern.
Figure 2:
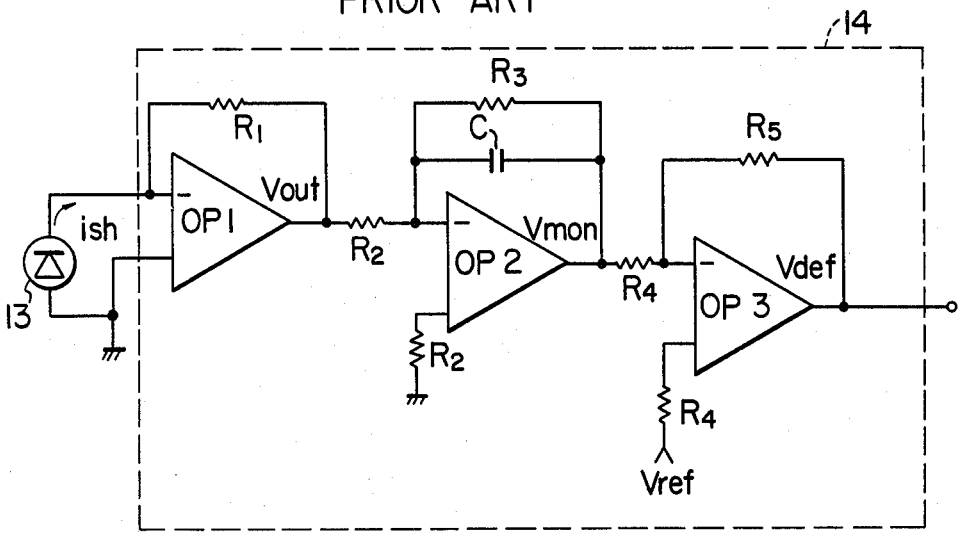
FIG. 2 PRIOR ART
FIG. 2 is a circuit diagram showing a control circuit in a conventional light quantity control device.

FIG. 1 shows the construction of a light source apparatus which is provided with a conventional light quantity control device to expose a light sensitive material through a mask pattern, and FIG. 2 is a circuit diagram showing a control circuit in the conventional light quantity control device. In FIG. 1, reference numeral 10 designates a leakage transformer, 11 a mercury discharge lamp connected to the secondary side of the leakage transformer 10, 12 a switching element formed of a bidirectional controlled rectifier, reference symbol R a resistor connected in parallel to the switching element 12 for supplying electric power to a mercury discharge lamp 11 even when the switching element is turned off, 20 and 21 input terminals for a commercial a.c. power source, 30 and 31 control input terminals connected respectively to the cathode electrode and gate electrode of the switching element 12 for performing a phase control for commercial a.c. power supplied to the leakage transformer 10, on the basis of an input control signal, and reference symbol L an inductor for suppressing an excess current flowing into the switching element 12 at a turn-on time. Reference symbol $L_o$ designates an inductor for preventing a transient current, and $C_o$ a capacitor for absorbing a high voltage wave due to a transient current.

Further, reference numeral 13 designates a photodiode acting as a light receiving element for detecting the quantity of light emitted from the mercury discharge lamp 11, and 14 a control circuit applied with the output of the photodiode 13 for delivering the control signal. In more detail, in the control circuit 14, the output of the photodiode 13 is amplified and the amplified output is compared with a reference signal to supply the control input terminals 30 and 31 with the control signal corresponding to a difference between the amplified output and reference signal. When the quantity of light emitted from the mercury discharge lamp (hereinafter referred to mercury lamp) 11 varies, the control signal is varied in accordance with such a variation, and the switching element 12 performs a phase control for a.c. input power having a sinusoidal waveform in a well-known manner to change the effective value of the a.c. power, thereby adjusting the quantity of light emitted from the mercury lamp 11. Thus, an automatic control is made so that the quantity of light from the mercury lamp 11 is always kept constant. Reference numeral 15 designates a pattern mask, 16 an optical system, and 17 a light sensitive material to be exposed for forming a pattern.

In FIG. 2, reference symbol OP1 designates an operational amplifier for converting a photocurrent $i_{sh}$ delivered from the photodiode 13 in proportion to a received light quantity into a voltage signal for making easy the control process, OP2 an operational amplifier for averaging a ripple in the output of the operational amplifier OP1, and OP3 an operational amplifier for comparing the output of the operational amplifier OP2 with a reference signal $V_{ref}$. Electric power supplied to the mercury lamp 11 is decreased or increased when the averaged output signal $V_{mon}$ from the operational amplifier OP2 is greater or smaller than the reference signal $V_{ref}$, respectively.

Figure 3:
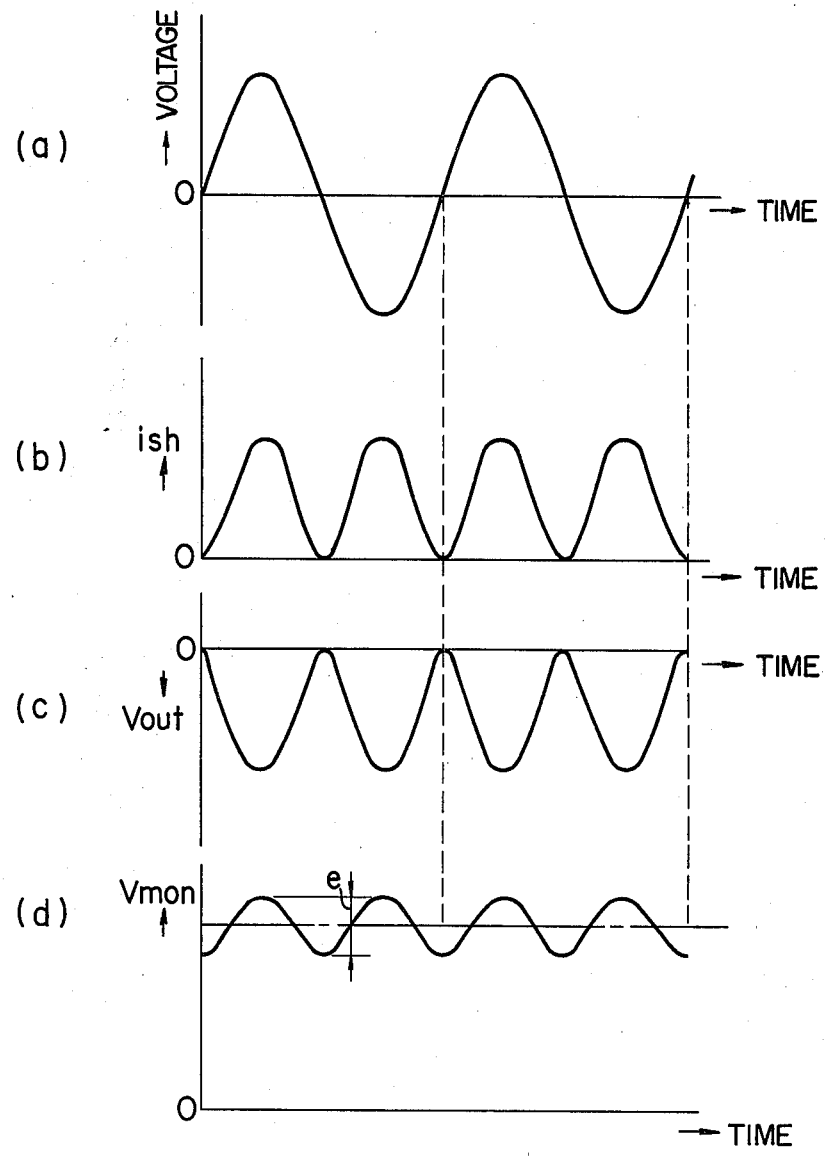
FIG. 3 is a waveform chart showing signal waveforms at various parts of the control circuit shown in FIG. 2.

FIG. 3 shows signal waveforms at various parts of the control circuit shown in FIG. 2. FIG. 3 shows in (a) the voltage waveform of the commercial a.c. power supply. When the mercury lamp 11 is lightened with such an a.c. voltage, the photocurrent $i_{sh}$ delivered from the photodiode 13 which receives light emitted from the mercury lamp 11, is a pulsating current which is twice higher in frequency than the commercial a.c. voltage, that is, has a period equal to one half the period of the commercial a.c. voltage, as shown in (b) of FIG. 3. With the photocurrent $i_{sh}$ having such a waveform, the operational amplifier OP1 delivers an output signal $V_{out}$ having a waveform such as shown in (c) of FIG. 3. When a feedback resistance of the operational amplifier OR1 is expressed by $R_1$, the output signal $V_{out}$ is given by the following equation:

$$V_{out} = -i_{sh} \times R_1 \quad (1)$$

When the input commercial a.c. power has a frequency of 50 Hz (namely, a period of 20 msec), the ripple in the output signal $V_{out}$ has a frequency of 100 Hz (namely, a period of 10 msec). Since it is not easy to compare the output signal $V_{out}$ having such a ripple with the reference signal, the output signal $V_{out}$ is applied to the operational amplifier OP2 to average the ripple, and an output signal $V_{mon}$ is delivered from the amplifier OP2. When an input resistance, a feedback resistance and a parallel capacitance of the operational amplifier OP2 are expressed by $R_2$, $R_3$ and C, respectively, and when the period of the ripple is less than a time constant $R_3C$, the output signal $V_{mon}$ is given by the following equation:

$$V_{mon} \approx -V_{out} \times \frac{R_3}{R_2} = i_{sh} \times R_1 \times \frac{R_3}{R_2} \quad (2)$$

The output signal $V_{mon}$ has such a waveform as shown in (d) of FIG. 3. As is apparent from FIG. 3, when the a.c. input voltage has a frequency of 50 Hz, a ripple contained in the output signal $V_{mon}$ has a frequency of 100 Hz. In (d) of FIG. 3, reference character e indicates a peak-to-peak value of the ripple. The output signal $V_{mon}$ having such a waveform is applied to the operational amplifier OP3 to be compared with the reference voltage signal $V_{ref}$, and an output signal $V_{def}$ is delivered from the amplifier OP3. The output signal $V_{def}$ is applied to a gate circuit (not shown) to obtain a phase control signal according to a well-known method. This control signal is a linear signal which varies linearly with the signal $V_{mon}$ (namely, a light quantity signal) proportional to the quantity of light emitted from the mercury lamp. When an input resistance and a feedback resistance of the operational amplifier OP3 are expressed by $R_4$ and $R_5$, respectively, the output signal $V_{def}$ obtained as a result of the above-mentioned comparison is given by the following equation:

$$V_{def} = -(V_{mon} - V_{ref}) \times \frac{R_5}{R_4} = \left(V_{ref} - i_{sh} \times \frac{R_1 \times R_3}{R_2}\right) \times \frac{R_5}{R_4} \quad (3)$$

The ratio of the resistance $R_5$ to the resistance $R_4$ gives a resolution for detecting a deviation of the quantity of light emitted from the light source from a reference value. For example, in the case where the quantity of light emitted from the light source is required to be constant within ±1%, the ratio $R_5/R_4$ is made greater than or equal to 100.

In such a conventional control circuit, a ripple component contained in the averaged output signal $V_{mon}$ obtained with the time constant $R_3C$, exists with frequency-gain characteristic of −20 dB/dec.

Further, taking into consideration the control accuracy at various parts of the control circuit, it is required that the ripple component is suppressed within one-tenth to one-half of the desired accuracy of ±1% for light quantity control, i.e. within ±0.1% to ±0.5% of the mean value of the output signal $V_{mon}$. When the ripple component having a frequency of 100 Hz is made equal to, for example, ±1% (namely, one-hundredth or −40 dB) of the mean value of the output signal $V_{mon}$ as in the present example, the cutoff frequency $f_o$ becomes 1 Hz as is known from a frequency-gain Bode's diagram. In this case, the time constant $R_3C$ is nearly equal to 1 sec. Also, when the above-mentioned ripple voltage is made equal to ±0.1% (namely, one-thousandth or −60 dB) of the mean value of the output signal $V_{mon}$, the cutoff frequency becomes 0.1 Hz, and the time constant $R_3C$ is nearly equal to 10 sec. Accordingly, in order to make the ripple voltage having a frequency of 100 Hz equal to ±0.1% to ±0.5% of the mean value of the output signal $V_{mon}$, it is required that the time constant $R_3C$ is about 5 to 10 sec. It undesirably brings about a delay in response to incorporate the averaging circuit made of the operational amplifier OP2 having such a time constant into the control circuit 14.

On the other hand, in order to improve the light quantity control accuracy, it is desirable to increase the gain of the operational amplifier OP3. However, in the case where the gain of the operational amplifier OP3 is made large, a difference in magnitude between the output signal $V_{mon}$ and reference voltage signal $V_{ref}$ is varied at the same period as the ripple voltage contained in the output signal $V_{mon}$. Thus, a square wave signal having the same frequency as the ripple voltage is produced as the output $V_{def}$ of the operational amplifier OP3. That is, the operational amplifier OP3 generates signals having opposite polarities repeatedly with a short period, resulting in impossibility of firing control of the switching element 12. As a result, it becomes impossible to control the quantity of light in a narrow range around the reference light quantity. Accordingly, it is required to make the ripple component contained in the output signal $V_{mon}$ as small as possible. For this purpose, however, the time content $R_3C$ must be made large, which results in a delay in response as mentioned above.

Further, since the operational amplifier OP3 performs only a comparing operation, a control signal obtained on the basis of the output of the operational amplifier OP3 varies linearly with the signal $V_{mon}$, that is, with the quantity of light emitted from the mercury lamp 11. In the case where such a linear control signal is used to perform a phase control for sinusoidal electric power applied to the input terminals 20 and 21, an effective value of the a.c. power supplied to the mercury lamp 11 varies substantially along with a cosine curve in accordance with a change in the light quantity signal obtained from the photodiode (refer to a curve g in FIG. 6). Although a desired control accuracy is obtained in the region of the light quantity signal where the light quantity signal-input power curve g has a large gradient, control accuracy is decreased in those regions of the light quantity signal where the curve g has a small gradient. Therefore, constant control accuracy cannot be expected.

SUMMARY OF THE INVENTION

It is accordingly an object of the present invention to provide a light quantity control device which can control the quantity of light emitted from a light source with high and constant accuracy, without involving a delay in response.

In order to attain the above object, a control circuit in a light quantity control device according to the present invention includes two integrating stages, one of which samples a signal based upon the quantity of emitted light, i.e. the emitted light quantity and at the same time reduces greatly a ripple component in this signal, and the other of which performs an exponential operation with respect to the output of the first integrating stage to obtain a control signal varying nonlinearly with a change in the quantity of emitted light.

DESCRIPTION OF THE PREFERRED EMBODIMENT

Figure 4:
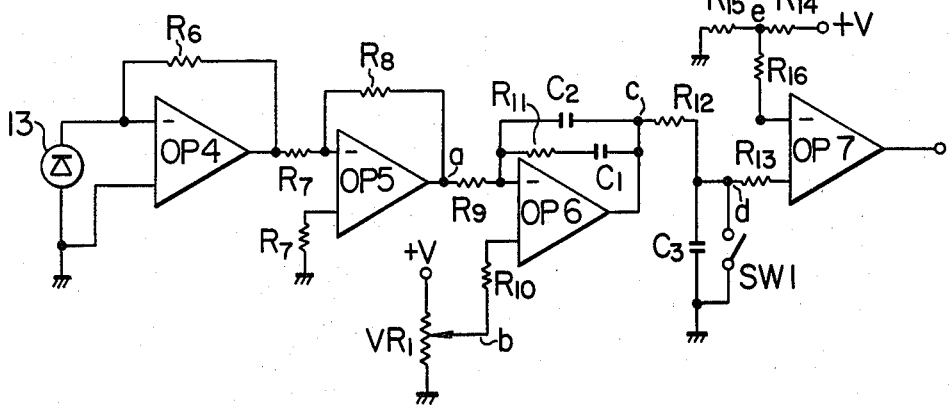
FIG. 4 is a circuit diagram showing a control circuit in a light quantity control device according to an embodiment of the present invention.
Figure 5:
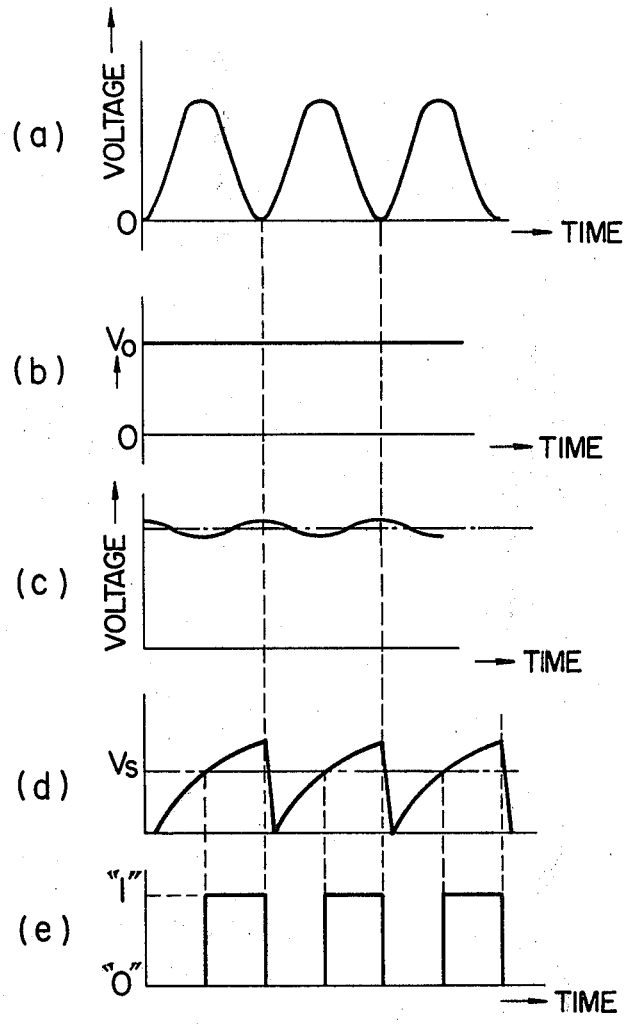
FIG. 5 is a waveform chart showing signal waveforms at various parts of the control circuit shown in FIG. 4.

FIG. 4 is a circuit diagram showing an embodiment of a control circuit in a light quantity control device according to the present invention, and FIG. 5 shows signal waveforms at various parts of the control circuit shown in FIG. 4. Referring to FIGS. 4 and 5, an operational amplifier OP4 having the same function as the operational amplifier OP1 shown in FIG. 2 outputs a voltage signal having such a waveform as shown in (c) of FIG. 3. The voltage signal is applied to an operational amplifier OP5 through an input resistor $R_7$ to be inverted and amplified. Thus, a signal having such a waveform as shown in (a) of FIG. 5 is sent to a point a. The inverting input terminal of an operational amplifier OP6 is applied with the signal at the point a through an input resistor $R_9$ and is also applied with a feedback signal through a feedback circuit including a series combination of a resistor $R_{11}$ and a capacitor $C_1$ connected in parallel to a capacitor $C_2$. The non-inverting input terminal of the operational amplifier OP6 is applied with a set value indicating signal of a voltage $V_o$ which is obtained by dividing a stabilized voltage $+V$ by a potentiometer VR1, through a resistor $R_{10}$ having the same resistance value as the resistor $R_9$. FIG. 5 shows in (b) a waveform of the set value indicating signal appearing at an output point b of the potentiometer VR1. The operational amplifier OP6 has two functions, one of which is to integrate the wavy signal at the point a with a time constant determined by the resistor $R_9$ and capacitor $C_2$, in accordance with a difference between the two inputs of the amplifier OP6, and the other function is to shift the output level of the amplifier OP6 by the potentiometer VR1 when it is required to change the quantity of light emitted from the mercury lamp 11. An output signal at an output point c of the operational amplifier OP6 has such a waveform as shown in (c) of FIG. 5. The series combination of the resistor $R_{11}$ and the capacitor $C_1$ is a phase lag compensating circuit for stabilizing the control operation. In the operational amplifier OP6, the resistor $R_{11}$ is made smaller in resistance than the resistor $R_9$, and the capacitor $C_1$ is made larger in capacitance than the capacitor $C_2$. With the operational amplifier OP6 having the above-mentioned circuit construction, in the case where the signal at the point b kept constant, the signal at the point c decreases or increases according as the signal at the point a increases or decreases. Further, in the case where the signal at the point a is kept constant, the signal at the point c increases or decreases according as the signal at the point b increases or decreases.

The signal at the point c shown in (c) of FIG. 5 is applied to a capacitor $C_3$ through a resistor $R_{12}$, so that the capacitor $C_3$ charges up. The resistor $R_{12}$ and the capacitor $C_3$ constitute an integrating circuit. Assuming that the signal at the point c is substantially a d.c. voltage of $V_c$, the voltage across the capacitor $C_3$ is expressed by the following exponential function:

$$V_c\left(1 - e^{-\frac{t}{C_3R_{12}}}\right) \quad (4)$$

where t indicates time, $C_3$ a capacitance of the capacitor $C_3$, and $R_{12}$ a resistance of the resistor $R_{12}$.

A switch SW1 connected in parallel to the capacitor $C_3$ is a well-known zero crossing switch, and is operated in synchronism with the commercial a.c. power supplied to the input terminals 20 and 21 (FIG. 1). The switch SW1 is turned on at a time when the commercial a.c. voltage takes a zero level. Accordingly, as soon as the switch SW1 is turned on, the capacitor $C_3$ is instantaneously discharged and reset. As a result, a signal at a terminal point d of the capacitor $C_3$ has a waveform such as shown in (d) in FIG. 5.

The signal at the point d is applied to the non-inverting input terminal of an operational amplifier OP7 through a resistor $R_{13}$. On the other hand, a reference signal having a voltage $V_s$ which is obtained by dividing the stabilized voltage $+V$ by resistor $R_{14}$ and $R_{15}$, namely, signal at a point e is applied to the inverting input terminal of the operational amplifier OP7 through a resistor $R_{16}$ having the same resistance as the resistor $R_{13}$. The two input signals are compared with each other in the operational amplifier OP7, and a firing control signal is sent from the amplifier OP7 to the switching element 12 (FIG. 1). The firing control signal is a square wave signal which takes a level "0" or "1" according as the signal at the point d is smaller or greater than the reference voltage $V_s$, as shown in (e) of FIG. 5. By firing the switching element 12 at the level "1" of the control signal, the phase control of the a.c. input power can be performed.

The operational amplifier OP6 constitutes the first integrating stage, and performs an integrating operation for the signal at the point a. Accordingly, a ripple component contained in the output of the operational amplifier OP6 is extermely small (refer to (c) of FIG. 5). Further, since the gain in the integrating operation is infinite in the d.c. sense, control accuracy can be improved. The time constant due to the resistor $R_9$ and capacitor $C_2$ determines a sampling time. At the beginning of the integrating operation made by the operational amplifier OP6, there is a dead time determined by the above-mentioned time constant. This dead time, however, involves only a phase shift corresponding to the dead time, but any delay in response is produced.

The resistor $R_{12}$ and the capacitor $C_3$ constructs the second integrating stage, and perform an exponential operation for an integrated value of the signal at the point a corresponding to the quantity of light emitted from the mercury lamp 11 during the sampling time. The resistor $R_{12}$ and the capacitor $C_3$ determines a time constant for the exponential operation. Since the ripple voltage contained in the output of the operational amplifier OP6 or the signal at the point c is very small, it is possible to make small the time constant $R_{12}C_3$. Therefore, a delay in response caused by this time constant also can be made small. For example, in an actual circuit having the construction shown in FIG. 2, when the resistance $R_2$, resistance $R_3$ and capacitance C are 1 kΩ, 62 kΩ and 10 μF, respectively, the time constant $R_3C$ becomes 620 msec. On the other hand, when an actual circuit having the construction shown in FIG. 4 includes circuit elements having such values as $R_9=R_{10}=33$ kΩ, $R_{11}=4.7$ kΩ, $C_1=10$ μF, $C_2=1$ μF, $R_{12}=22$ kΩ, and $C_3=1$ μF, the time constant $R_{12}C_3$ becomes equal to 22 msec.

In the above-mentioned embodiment, a phase control is performed for the sinusoidal a.c. power by a control signal which is obtained on the basis of the signal at the point d having an exponential characteristic to the light quantity signal (namely, the signal at the point c inversely proportional to the quantity of light emitted from the mercury lamp). Accordingly, an approximately linear relation is obtained between a change in light quantity and an effective value of power supplied to the mercury lamp 11. In general, in the case where the waveform of an a.c. voltage is given by sin $\theta$, the waveform of a.c. power is given by an integrated value of the a.c. voltage, and is expressed by $(1-\cos\theta)$. When a phase control is made for such a.c. power with the conventional linear control signal, electric power supplied to the mercury lamp 11 is given by $(1-\cos\theta)$, and therefore it is impossible to obtain constant control accuracy. According to the present embodiment, a phase control is performed for the a.c. power in accordance with exponential curves which are successively obtained for the quantities of light generated during every predetermined time, as shown in (d), (e) and (f) of FIG. 7 which will be explained later in detail. As a result, the above-mentioned linear relation can be obtained.

Figure 6:
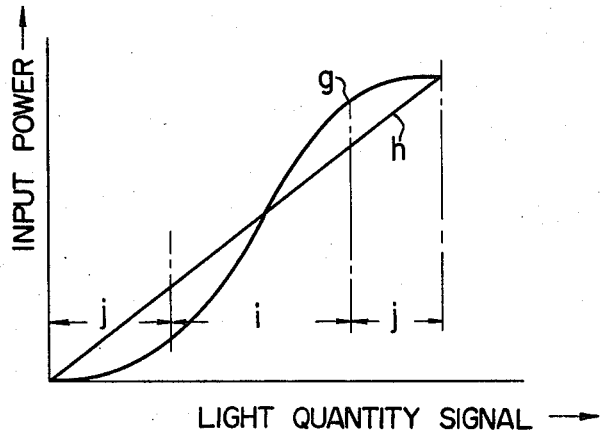
FIG. 6 is a graph showing a relation between a light quantity signal and electric power supplied to a mercury discharge lamp.

FIG. 6 is a graph showing relations between the light quantity signal and the input power supplied to the mercury lamp. In FIG. 6, the curve g indicates the prior art characteristics and a curve h a characteristic of the present embodiment. In the case of the curve g, the gradient of input power with respect to light quantity signal is large in a range i, and therefore the control sensitivity is high in this range. However, in ranges j, the gradient of input power decreases greatly, and therefore the control sensitivity is low, thereby reducing the control accuracy. For example, according to experiments carried out using a 1 kW extra-high pressure mercury lamp, in the control device having the characteristic indicated by the curve g, the control accuracy was ±0.2% in the range i, but was ±5% in the ranges j. On the other hand, in the present embodiment having the characteristic indicated by the curve h, the control accuracy was less than ±1% in the whole range of the light quantity signal.

Figure 7:
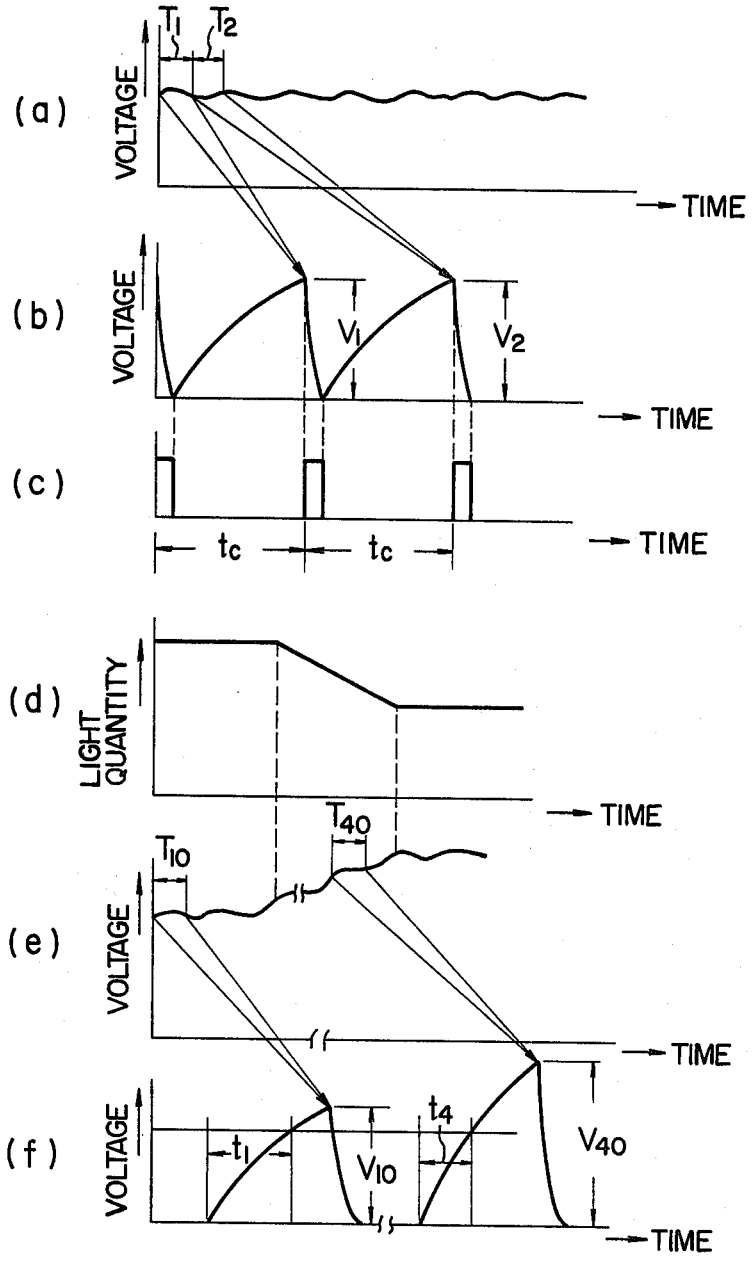
FIG. 7 is a signal waveform chart for explaining the control operation of the control circuit shown in FIG. 4.

Now, a change in the control signal shown in (e) of FIG. 5 due to a change in the signal shown in (d) of FIG. 5 will be explained below in more detail, with reference to FIG. 7. FIG. 7 shows in (a) and (b) the waveforms of the signals shown in (c) and (d) of FIG. 5 respectively.

In general, when a phase control is performed, it is necessary to define a reference time for timing the firing of a switching element and a period from the reference time to the firing (i.e. firing angle). In the present embodiment, the integrating operation with the time constant $R_9C_2$ and the integrating operation with the time constant $R_{12}C_3$ are performed. In the first integrating circuit, the light quantity signal is integrated which corresponds to the quantity of light emitted during each of predetermined times $T_1$, $T_2$, . . . (the sampling time $R_9C_2$). In the second integrating circuit, the firing angle is determined from the integrated value delivered from the first integrating circuit. FIG. 7 shows in (c) the operation of the switch SW1 shown in FIG. 4, and the high level shows the ON-state of the switch SW1. The ON-state time is the reference time for determining a firing angle. The period $t_c$ of the turning-on of the switch SW1 determines the reset period of the integrating circuit made of the resistor $R_{12}$ and capacitor $C_3$, which is equal to a half the period of the a.c. voltage in the present embodiment. The time constant $R_9C_2$ is selected to ten times larger than the light emitting period which is equal to the period $t_c$, and 10 msec in the case of an a.c. voltage of 50 Hz, and the time constant $R_{12}C_3$ is selected to three times larger than the light emitting period. In addition, the time constant $R_{11}C_1$ of the phase lag compensating circuit is set to one to ten times larger than the time constant $R_9C_2$.

When the quantity of emitted light is reduced at a certain time for some reason as shown in (d) of FIG. 7, the signal at the point c is raised as shown in (e) of FIG. 7, and therefore the signal at the point d is varied as shown in (f) of FIG. 7. In more detail, the signal at the point d has a voltage of $V_{10}$ when the signal at the point c is integrated for the time $T_{10}$, but has a voltage of $V_{40}$ when the signal at the point c is integrated for the time $T_{40}$ after the quantity of emitted light has been reduced. These voltages are compared with the same reference voltage $V_s$. It takes a time $t_1$ for the signal of voltage $V_{10}$ for the time $T_{10}$ to charge the capacitor $C_3$ to the voltage $V_s$, and a time required for the signal of voltage $V_{40}$ for the time $T_{40}$ to charge the capacitor $C_3$ to the voltage $V_s$ is $t_4$. Accordingly, after the quantity of emitted light has been reduced, the phase control is performed in such a manner that the switching element is fired earlier than before by $(t_1-t_4)$. Thus, power supplied to the mercury lamp is increased,, and the quantity of emitted light is thereby increased. As mentioned above, when the quantity of emitted light is reduced, the switching element is fired earlier than before, and thus a reduction in light quantity is automatically corrected. When the quantity of emitted light is increased, the switching element is fired later than before, and thus an increase in light quantity is also corrected automatically.

As mentioned above, in the present embodiment, the phase control is carried out in accordance with the exponential curve of the signal obtained in correspondence with the quantity of light emitted during the predetermined time of $T_1$, $T_2$, . . . as shown in (d), (e) and (f) of FIG. 7. As a result, a linear relation is obtained between the light quantity signal and the effective value of power supplied to the mercury lamp, and therefore constant control accuracy is obtained. Further, a delay in response occurring in the control circuit shown in FIG. 4 is based only on the time constant $R_{12}C_3$, and this time constant is very small as mentioned previously. Thus, according to the present invention, it is possible to control the quantity of light emitted from the mercury lamp 11 with constant and high accuracy, with a minimum delay in response. For example, in the case where a 2 kW water-cooled extra-high pressure mercury lamp was used, when the light source had a response time of 100 msec, a response time of about 120 msec was observed in the operation of the control circuit, and therefore it was possible to carry out a high-speed control with control accuracy within ±1%.

We claim:

1. A light quantity control device for controlling the quantity of light emitted from a light source supplied with a.c. power through a switching element having a bidirectional controlled rectifier, comprising:

a light receiving element for converting light from said light source into an electric signal;

a processing circuit for processing said electric signal to generate an output signal corresponding to said electric signal;

a first integrating circuit for integrating said output signal from said processing circuit to produce a light quantity signal, said light quantity signal having varied in accordance with a change in quantity of light emitted from said light source;

a second integrating circuit for integrating said light quantity signal with a predetermined period; and a comparing circuit for comparing an output signal of said second integrating circuit with a reference signal to produce a control signal for said switching element in accordance with a result of comparison.

2. A light quantity control device according to claim 1, wherein said first ingegrating circuit includes means for determining a predetermined time, and said second integrating circuit includes reset means for integrating the light quantity signal of said first integrating circuit obtained for said predetermined time, for every said predetermined period.

3. A light quantity control device according to claim 2, wherein said means for determining said predetermined time is made up of a resistor and a capacitor which determine a time constant of said first integrating circuit, and said reset means is formed of switching means which operates in synchronism with an a.c. input voltage to form a discharge circuit of said second integrating circuit.

4. A light quantity control device for controlling the quantity of light emitted from a light source supplied with a.c. power through a switching element having a bidirectional controlled rectifier, comprising:

a light receiving element for converting light from said light source into an electric signal;

a processing circuit for processing said electric signal to generate an output signal corresponding to said electric signal;

a first integrating circuit for integrating said output signal from said processing circuit to produce a light quantity signal, said light quantity signal being varied in accordance with a change in quantity of light emitted from said light source;

a second integrating circuit for integrating said light quantity signal with a predetermined period to produce an exponentially rising signal for every said predetermined period on the basis of the light quantity signal obtained for a predetermined time; and a comparing circuit for comparing the exponentially rising signal of said second integrating circuit with a reference signal to produce a control signal, said control signal having a duration time determined depending upon said exponentially rising signal, said switching element being controlled by said control signal to carry out a phase control for said a.c. power.

* * * * *